US005411137A

United States Patent [19]

Weder et al.

[11] Patent Number: 5,411,137

[45] Date of Patent: * May 2, 1995

[54] RETAINING FLAP FOR SHIPPING CARTONS

[75] Inventors: Donald E. Weder, Highland; Jack Feld, Edwardsville, both of Ill.

[73] Assignee: Highland Supply Corporation, Highland, Ill.

[ * ] Notice: The portion of the term of this patent subsequent to May 17, 2011 has been disclaimed.

[21] Appl. No.: 202,058

[22] Filed: Feb. 25, 1994

Related U.S. Application Data

[63] Continuation of Ser. No. 93,109, Jul. 16, 1993, Pat. No. 5,311,992, which is a continuation-in-part of Ser. No. 892,441, Jun. 2, 1992, Pat. No. 5,240,109, which is a continuation-in-part of Ser. No. 692,329, Apr. 26, 1991, Pat. No. 5,092,465.

[51] Int. Cl.[6] ..... B65D 85/50

[52] U.S. Cl. ..... 206/423; 206/813

[58] Field of Search ..... 206/813, 423

[56] References Cited

U.S. PATENT DOCUMENTS

| | | | |
|---|---|---|---|
| 2,707,352 | 5/1955 | Fischer et al. | 47/58 |
| 2,744,624 | 5/1956 | Hoogstoel et al. | 206/813 |
| 3,524,583 | 8/1970 | Gregory | 206/813 |
| 5,092,465 | 3/1992 | Weder et al. | 206/423 |
| 5,148,918 | 9/1992 | Weder et al. | 206/423 |
| 5,195,637 | 3/1993 | Weder | 206/423 |
| 5,240,109 | 8/1993 | Weder et al. | 206/423 |
| 5,255,784 | 10/1993 | Weder et al. | 206/423 |

FOREIGN PATENT DOCUMENTS

| | | | |
|---|---|---|---|
| 2221936 | 10/1974 | France . | |
| 2675774 | 10/1992 | France | 206/472 |

*Primary Examiner*—Jimmy G. Foster
*Attorney, Agent, or Firm*—Dunlap & Codding

[57] ABSTRACT

Retaining flaps for shipping cartons, with bonding material disposed on at least a portion of the flaps, are provided. The flaps are interposed between delicate items, such as, for example, floral grouping assemblies, to hold the delicate items essentially immobile within a shipping carton in order to prevent damage from internal movement of the delicate items when the shipping carton is transported. The bonding material disposed on the flaps releasably connects to portions of the floral grouping wrappings and to portions of the internal surface of the shipping carton. The flaps can be constructed of a flexible or a rigid material.

28 Claims, 7 Drawing Sheets

RETAINING FLAP FOR SHIPPING CARTONS

This application is a continuation of U.S. Ser. No. 093,109, filed Jul. 16, 1993, now issued as U.S. Pat. No. 5,311,992, May 17, 1994, titled, "RETAINING FLAP FOR SHIPPING CARTONS"; which is a continuation-in-part of U.S. Ser. No. 892,441, filed Jun. 2, 1992, issued as U.S. Pat. No. 5,240,109, which is a continuation-in-part of U.S. Ser. No. 692,329, filed Apr. 26, 1991, issued as U.S. Pat. No. 5,092,465, Mar. 3, 1992, titled, "SHIPPING CARTON FOR FLORAL GROUPING ASSEMBLIES".

FIELD OF THE INVENTION

The present invention generally relates to cartons for shipping or transporting delicate items, such as floral groupings, and more specifically to retaining flaps which are interposed between and among the delicate items, in order to substantially immobilize the delicate items within the shipping carton to thereby prevent damage to the delicate items by movement.

BRIEF DESCRIPTION OF THE DRAWINGS

FIG. 6 is a perspective view of two flexible retaining flaps, similar to the retaining flap shown in FIG. 2, disposed about a plurality of floral grouping assemblies.

DESCRIPTION OF THE PREFERRED EMBODIMENTS

Figure 1:
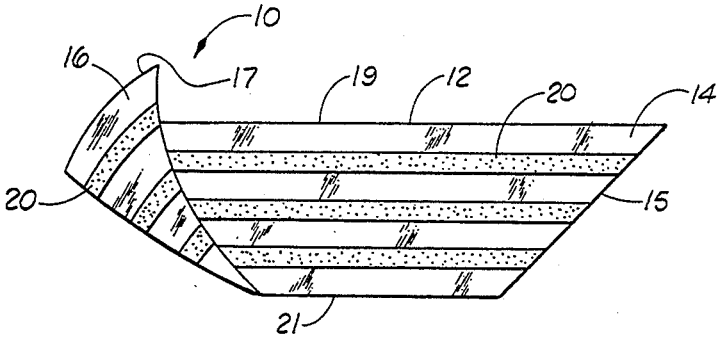
FIG. 1 is a perspective view of a flexible retaining wrap constructed in accordance with the present invention.

Shown in FIG. 1 is a retaining flap constructed in accordance with the present invention and designated by the general reference numeral 10. The flap 10 is constructed of a flexible sheet of material 12 having an upper surface 14, a lower surface 16, a first end 15, a second end 17, a first side 19 and a second side 21. A bonding material is disposed in strips of bonding material, one strip bonding material being shown and designated with the reference numeral 20, the strips of bonding material, such as bonding material strip 20, extending generally from the first end 15 to the second end 17 of the sheet of material 12.

The sheet of material 12 is constructed from any suitable flexible material that is capable of being formed in accordance with the present invention, as will be explained below. Preferably, the flexible sheet of material 12 is constructed of a material selected from a group of materials consisting of paper, metal foil, cloth (natural or synthetic), denim, burlap or polymer film or combinations thereof.

The term "polymer" is used herein means any polymer film. For example, but not by way of limitation, one polymer film is a polypropylene film. Another example of a polymer film, is cellophane.

The sheet of material 12 has a thickness in a range from about 0.1 mils to about 30 mils. Preferably, the sheet of material has a thickness in a range from about 0.1 mils to about 5 mils. The sheet of material 12 may be of any shape and a rectangular shape is shown in FIG. 1 only by way of example. The sheet of material, for example, may be square, circular, or any other geometric shape. The sheet of material 12 may be constructed of a single layer of material or a plurality of layers of the same or different types of materials. Any thickness of the sheet of material 12 may be utilized with the present invention as long as the sheet of material is capable of being formed in accordance with the present invention. The layers of material comprising the sheet of material 12 may be connected together or laminated or may be separate layers.

The term "bonding material" as used herein means a pressure sensitive adhesive, preferably a pressure sensitive adhesive, or a cohesive. Where the bonding material is a cohesive, a similar cohesive material must be placed on the adjacent surface for bondingly contacting and bondingly engaging with the cohesive material. The term "bonding material" as used herein means any type of material or thing which can be used to effect the bonding or connecting of the two adjacent portions of the material or sheet of material as described herein.

Figure 2:
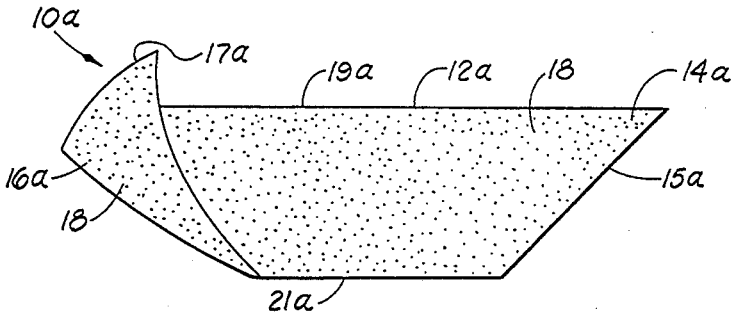
FIG. 2 is a perspective view of another flexible retaining flap constructed in accordance with the present invention.

Shown in FIG. 2 is a flap **10*a* constructed of a flexible sheet of material 12*a*, end having an upper surface 14*a*, a lower surface 16*a*, a first end 15*a*, a second end 17*a*, a first side 19*a*, and a second side 21*a*. The flexible sheet of material 12*a*, as shown in FIG. 2, has bonding material 18 disposed generally across the upper surface 14*a* and the lower surface 16*a* of the sheet of material 12*a***.

Figure 3:
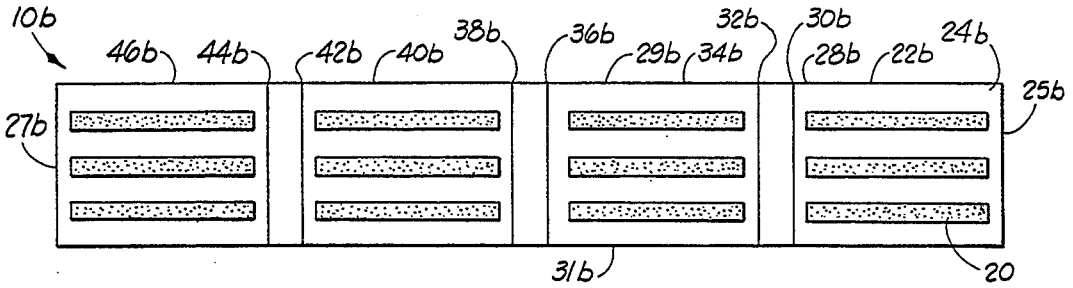
FIG. 3 is a perspective view of a retaining flap comprising a rigid material and constructed in accordance with the present invention.

Shown in FIG. 3 is a retaining flap **10*b* constructed in accordance with the present invention. The flap 10*b* is constructed of a rigid sheet of material 22*b*. The rigid sheet of material 22*b* comprises any material that can be formed in accordance with the present invention. Examples of materials from which the rigid sheet of material 22*b* can be constructed include, solely by way of illustration and not by way of limitation, cardboard, metal foil, such as aluminum foil, and plastic sheet, such as polyethylene sheet. The rigid sheet of material 22*b* includes an upper surface 24*b*, a lower surface 26*b* (not shown) a first end 25*b*, a second end 27*b*, a first side 29*b*, and the second side 31*b***.

The rigid sheet of material **22*b* also comprises at least two panels, the rigid sheet of material 22*b* shown in FIG. 3 comprising a first panel 28b, a second panel 34b, a third panel 40b, and a fourth panel 46b**.

The first panel 28b extends generally from the first end 25b to the fold line 30b. A fold line 32b is separated a distance from the fold line 30b and the second panel extends from the fold line 32b to the fold line 36b. A fold line 38b is separate a distance from the fold line 36b, and the third panel 40b extends from the fold line 38b to a fold line 42b. The fold line 44b is separated a distance from the fold line 42b and the fourth panel 46b extends generally from the fold line 44b to the second end 27b of the rigid sheet of material 22b. As shown in FIG. 3, the panels 28b, 34b, 40b, and 46b, are generally the same size, but in other embodiments of the invention, the size of the panels comprising a sheet of material 22d can vary.

Figure 4:
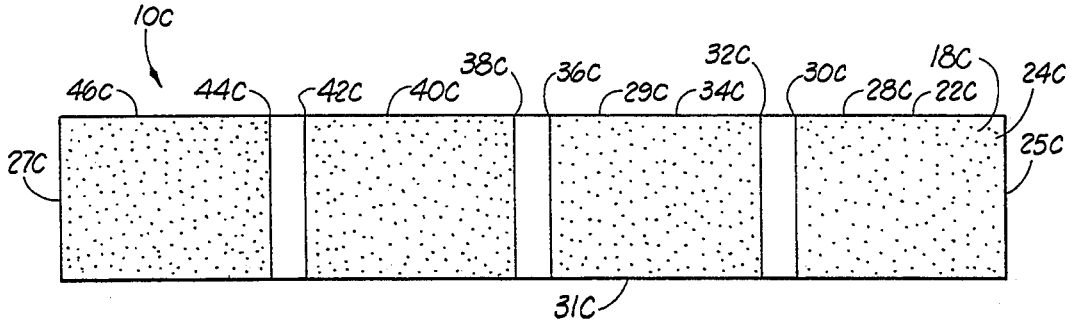
FIG. 4 is a perspective view of another retaining flap comprising a rigid material and constructed in accordance with the present invention.

The rigid sheet of material 22b additionally has strips of bonding material 20 disposed on the upper surface 24b and the lower surface 26b (not shown). One strip of bonding material is designated generally by the reference numeral FIG. 4 shows a retaining flap 10c constructed of a rigid sheet of material 22c. The rigid sheet of material 22c has a upper surface 24c, a lower surface 26c (not shown). A first end 25c, a second end 27c, and a first side 29c and a second side 31c. The retaining flap 10c will comprise at least two panels. The retaining flap 10c shown in FIG. 4 comprises a first panel 28c, e second panel 34c, a third panel 40c a fourth panel 46c. The first panel 28c extends generally from the first end 25c to a fold line 30c. A fold line 32c is separated a distance from the fold line 30c, and the second panel 34c extends from the fold line 32c to a fold line 36c. A fold line 38c is separated a distance from the fold line 36c, and the third panel 40c extends from the fold line 36c to a fold line 42c. The fold line 44c is separated a distance from the fold line 42c and a fourth panel 46c extends from the fold line 44c to the second end 27c of the flexible or rigid sheet of material 22c. A bonding material 18 is disposed generally on the panels, such as the panels 28c, 34c, 40c and 46c shown in FIG. 4, on the first side 24c and the second side 26c of the rigid sheet of material 22c.

Figure 5:
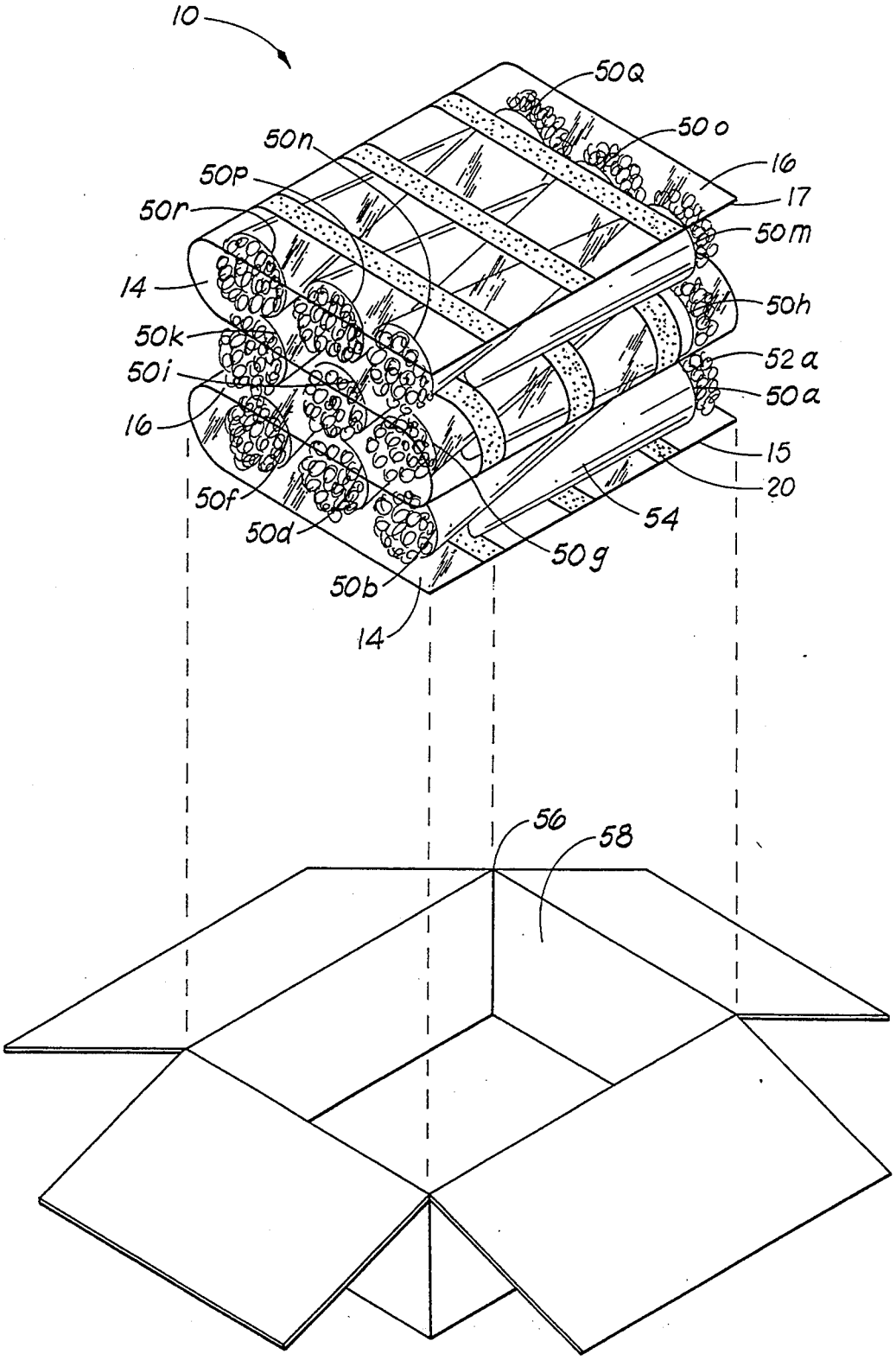
FIG. 5 is a perspective view of the flexible retaining flap shown in FIG. 1 disposed about plurality of floral grouping assemblies.

FIG. 5 is a perspective view of a retaining flap 10, constructed in accordance with the present invention, disposed about a plurality of floral grouping assemblies 50. As shown in FIG. 5, the floral grouping assemblies 50 are oriented to be disposed in a carton or carton 56 having an inner surface 58 defining a receiving space. A first layer of floral grouping assemblies is comprised of the floral grouping assemblies 50a through 50f. A second layer of floral grouping assemblies is comprised of the floral grouping assemblies 50g through 501 (501 not shown), and a third layer of floral grouping assemblies is comprised of the floral grouping assemblies 50m through 50r. Floral grouping assembly 50a is representative of the floral grouping assemblies 50 shown in FIG. 5. The floral grouping assembly 50a comprises a floral grouping having a bloom end 52a and a stem end, which is generally encompassed by a floral grouping wrap 54. The present invention can also be used with a floral grouping without the floral grouping wrap 54. In that event, the bonding material disposed on the retention flap, such as the retention flaps 10 or 10a, will comprise an adhesive. Floral groupings, in general, possess the characteristic of being of delicate construction, and are subject to crushing and tearing when a plurality of floral grouping assemblies 50 are placed in a carton, such as the carton 56. The floral grouping assemblies 50 may be compressed or torn when additional floral grouping assemblies 50 are placed in the carton 56, or as a result of movement of the floral groupings assemblies 50 within the carton 56 unless the floral grouping assemblies 50 are essentially immobilized.

As shown in FIG. 5, the first end 15 and the upper surface 14 of the flexible sheet of material 12 is placed generally underneath the first layer of floral grouping assemblies 50a to 50f. The bonding strips, such as bonding strip 20, releasably connect to a portion of the floral grouping wrap comprising part of a floral grouping assembly, such as the floral grouping wrap 54 comprising part of the floral grouping assembly 50a.

The sheet of material 22 is then fed over the first layer of floral grouping assemblies 50a to 50f so the first surface 14 of the sheet of material 12 releasably connects to additional portions of the floral wrap comprising part of the floral grouping assemblies 50a to 50f. The second layer of floral grouping assemblies 50g through 501 is placed on a portion of the lower surface 16 of the sheet of material 12 so that a portion of the floral wrap comprising the floral grouping assemblies 50g through 501 is releasably connected to the lower surface 16 of the sheet of material 12 via the bonding strips, such as the bonding strip 20. The sheet of material is then folded over the second layer of floral grouping assemblies 50g through 501 so that an additional portion of the lower surface 16 of the sheet of material 12 comes in contact, via the bonding strips, with additional portions of the floral wrap comprising part of the floral grouping assemblies 50g through 501. Finally, a third layer of floral grouping assemblies 50m through 50r is disposed on the upper surface 14 on an additional portion of the upper surface 14 of the sheet of material 12, a portion of the floral wrap comprising the floral grouping assemblies 50m through 50r coming in contact with the bonding strips disposed of the upper surface 14 of the sheet of material 12. The sheet of material 12 is folded over the third layer of floral grouping assemblies 50m through 50r so an additional portion of the bonding strips disposed on the upper surface 14 of the sheet of material 12 comes in contact with an additional portion of the floral wrap comprising the floral grouping assemblies 50m through 50r.

It is understood that the general size of the sheet of material 12 will be determined by the number of floral grouping assemblies 50 to be disposed in the carton 56. Three layers of floral grouping assemblies 50 are shown in FIG. 5, but additional layers, or fewer layers, can be used, consistent with the present invention. Generally, however, it is contemplated that at least a first layer of floral grouping assemblies 50 and a second layer of floral grouping assemblies 50 will be used in accordance with the present invention.

FIG. 6 shows a perspective view of two retaining flaps, designated generally as retaining flaps 10' and 10'', constructed in accordance with the present invention. As shown in FIG. 6, the flaps 10' and 10'' are interwoven among a first layer of floral grouping assemblies 50a to 50f, a second layer of floral grouping assemblies 50g and 501, and a third layer of floral grouping assemblies 50m and 50r, in exactly the same manner as the flap 10 shown in FIG. 5. However, the flap 10 shown in FIG. 5 is sized to generally fit within the cross sectional space defined by the inner surface 58 of the carton 56, whereas two flaps 10' and 10'' performing the same function but occupying less space, are shown in FIG. 6. It is understood that, in a particular embodiment of the invention, additional flaps, such as flaps 10' and 10'', or since flap 10' can be used in accordance with the invention. The flaps 10' and 10'' have bonding material 18' or 18'' disposed on the surfaces thereof, the bonding material 18' or 18'' releasably connecting to a portion of the floral wraps of the floral grouping assemblies 50*a* to 50*r* to hold the floral groupings 50*a* to 50*r* essentially immobile when the floral groupings 50*a* to 50*r* and disposed in the carton 56.

Figure 7:
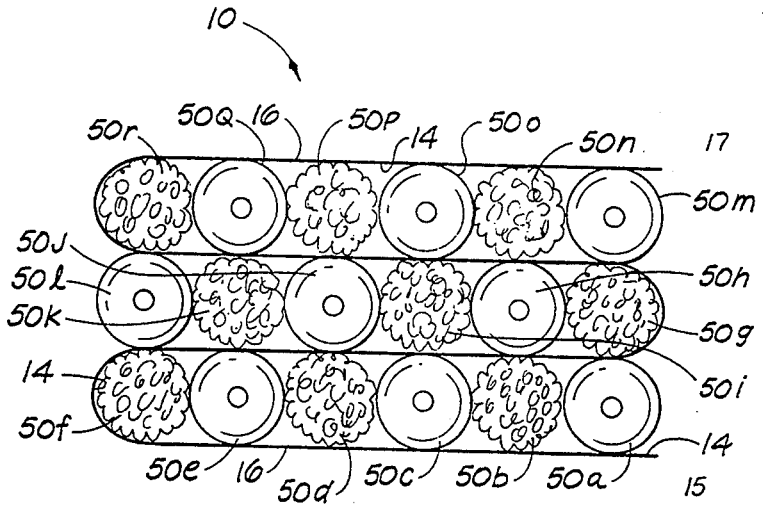
FIG. 7 is a side view of the flexible retaining flap shown in FIG. 1, disposed about a plurality of floral grouping assemblies.
Figure 8:
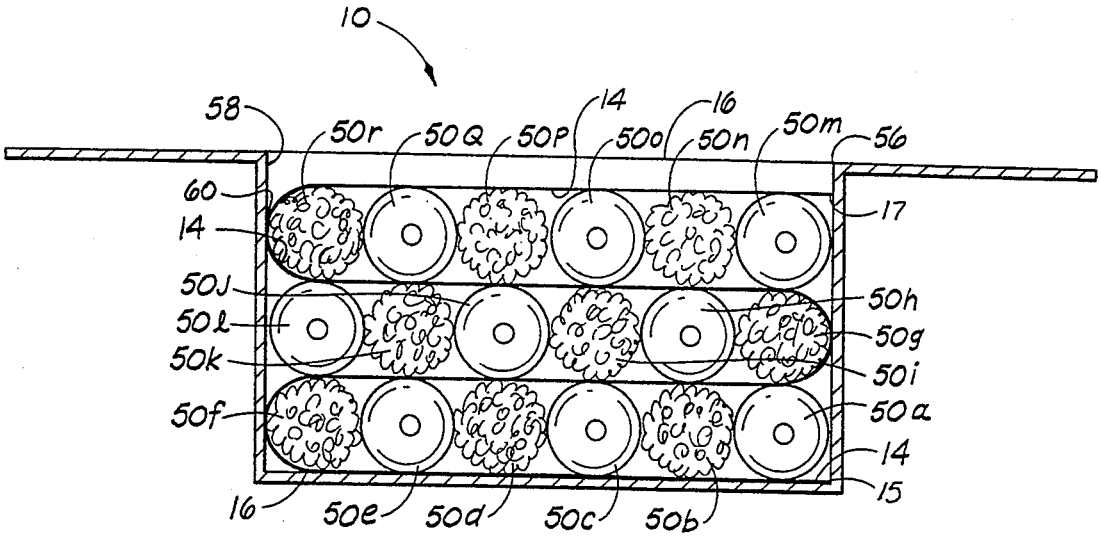

Shown in FIG. 7, is a side view of a flap 10 disposed about a first layer of floral grouping assemblies 50*a* to 50*f*, a second layer of floral grouping assemblies 50*g* to 501, and a third layer of floral grouping assemblies 50*m* through 50*r*. As shown in FIG. 7, the flap 10 operates to hold the floral grouping assemblies 50 essentially immobile and in a fixed orientation relative to each other.

Figure 8:
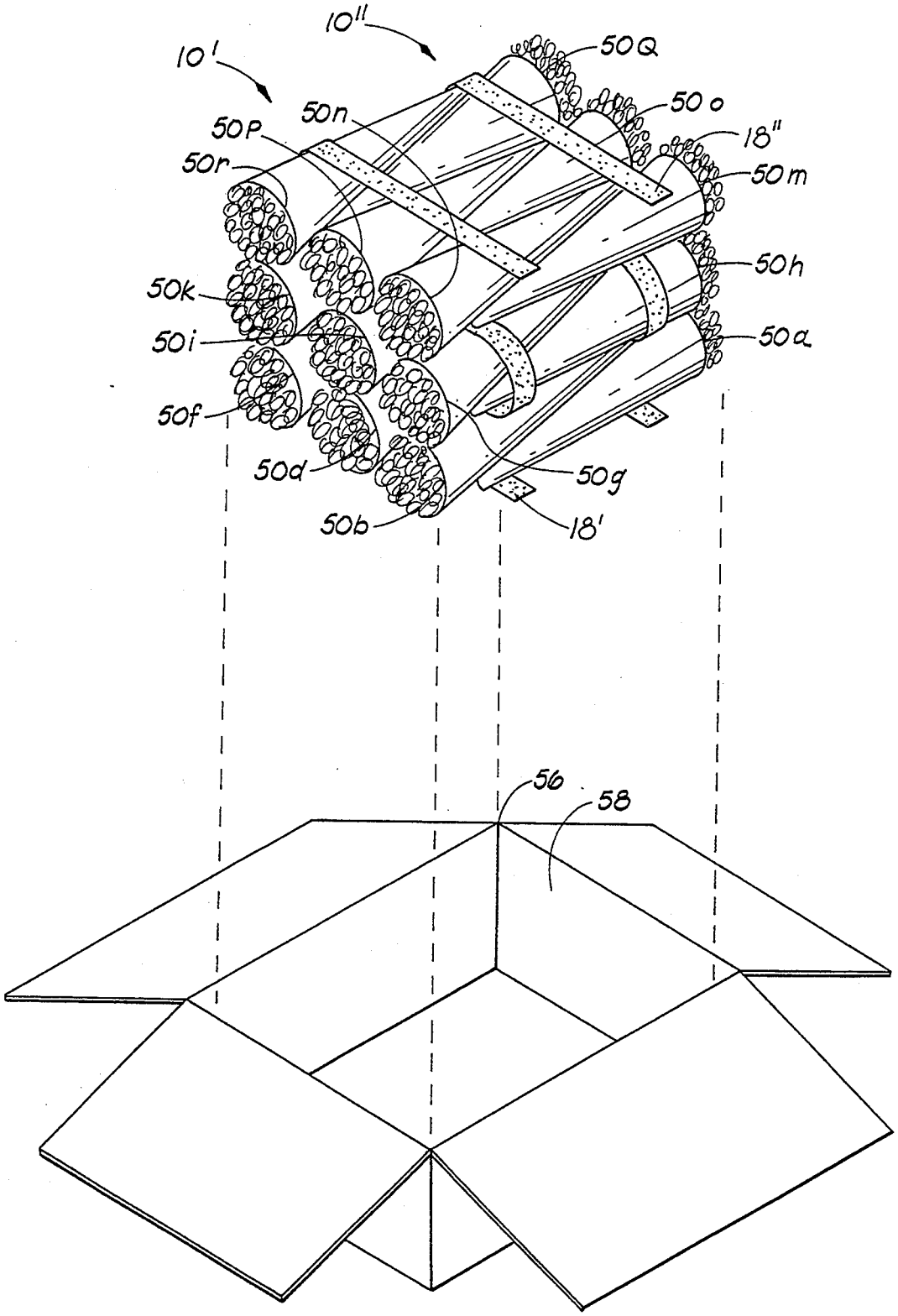
FIG. 8 is a side view of the retaining flap and floral grouping assemblies shown in FIG. 7, disposed in a carton.

Shown in FIG. 8 are the floral grouping assemblies 50*a* through 50*r* shown in FIG. 7, with the retaining flap 10 shown in FIG. 7 disposed about the floral grouping assemblies 50*a* to 50*r*, the floral grouping assemblies 50*a* to 50*r* being disposed in the receiving space of a carton 56. As shown in FIG. 8, the lower surface 16 of the sheet of material 22 is located generally adjacent a portion of the inner surface 58 of the carton 56, and the upper surface 14 of the sheet of material 22 is disposed generally under a first layer of floral grouping assemblies 50*a* through 50*f*. A portion of the bonding strips disposed on the sheet of material 22 (not shown), located on the lower surface 16 of the sheet of material 22 comes in contact with a portion of the inner surface 58 of the carton 56, thereby holding the portion of the sheet of material 22 in contact with a portion of the inner surface 58 of the carton 55 generally immobile within the carton 56. In turn, portions of the floral wrap comprising a portion of the floral grouping assemblies 50*a* through 50*f* is in contact with at least a portion of the bonding strips disposed on the upper surface 14 of the sheet of material 12, causing the floral grouping assemblies 50*a* through 50*f* to be held generally immobile on a portion of the sheet of material 12.

The sheet of material 12 is generally held against an additional posts of the inner surface 58 of the carton 56 at other contact points, such as the contact point 60. The sheet of material 12 therefor cooperates with the carton 56 to hold the floral grouping assemblies 50 generally immobile within the carton 56.

Figure 9:
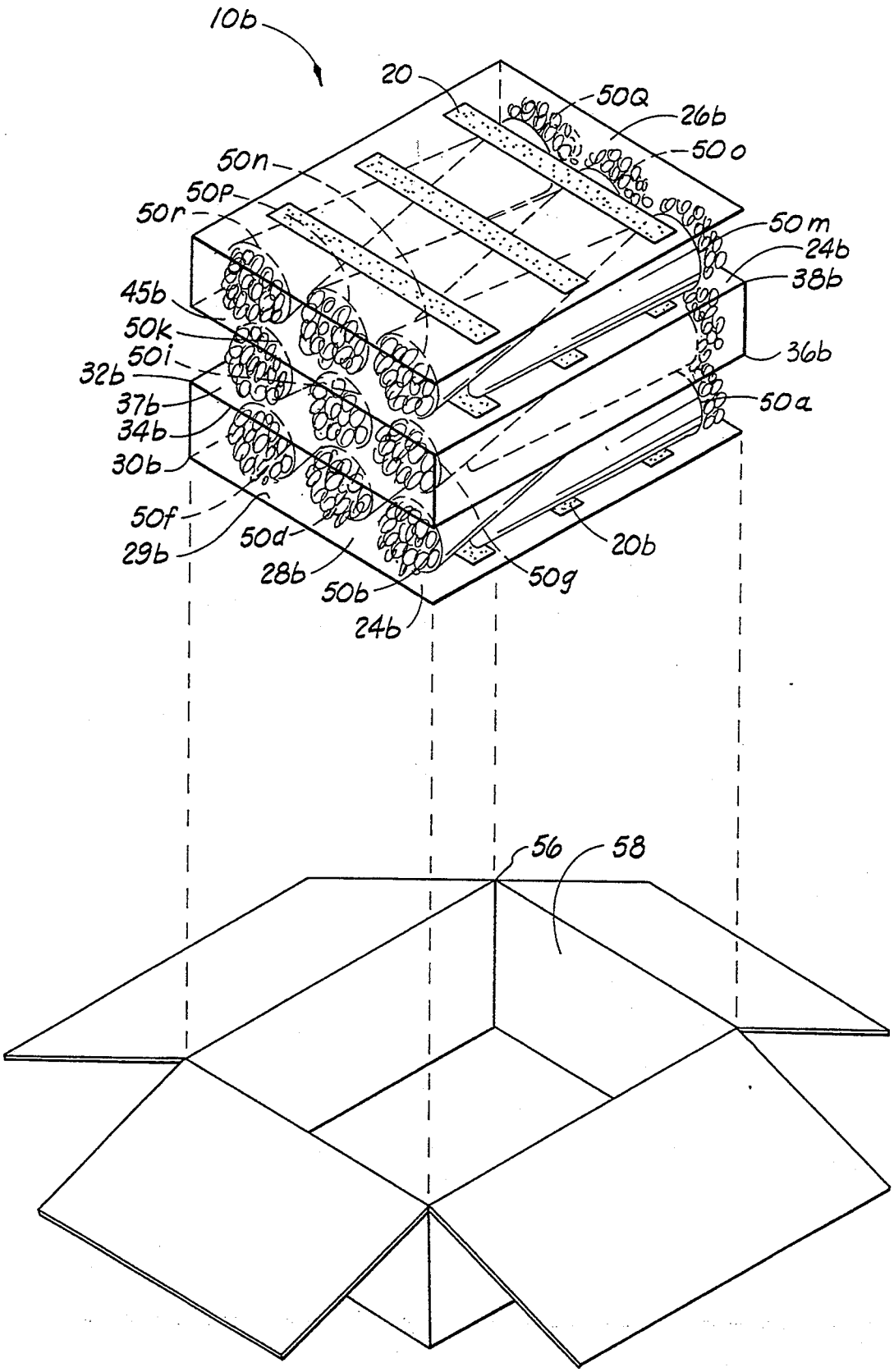
FIG. 9 is a perspective view of the retaining flap shown in FIG. 3 disposed about a plurality of floral grouping assemblies.

Shown in FIG. 9 is the retaining flap 10*b* shown in FIG. 3 disposed about a plurality of floral grouping assemblies 50*a* to 50*r*. The retaining flap 10*b* comprises a first panel 28*b*, which is disposed generally underneath a first layer of floral grouping assemblies 50*a* to 50*f*, a second panel 32*b*, disposed generally between the first layer of floral grouping assemblies 50*a* to 50*f* and a second layer of floral grouping assemblies 50*h* through 501, the first panel 28*b* and the second panel 34*b* cooperating to form a first retention pocket 29*b*, generally encompassing the first layer of floral grouping assemblies 50*a* to 50*f*.

The third panel 40*b* extends generally above the second layer of floral grouping assemblies 50*g* through 501 forming a second retention pocket 37*b* and the fourth panel extending generally above the third layer of floral grouping assemblies 50*m* through 50*r* forming, with the second panel, a third retention pocket 45*b*.

The effect of folding the first panel 28*b*, the second panel 34*b*, the third panel 40*b* and the fourth panel 46*b* as shown in FIG. 9 is to create three retention pockets 29*b*, 37*b* and 45*b*, the retention pockets each securing a portion of the floral grouping assemblies 50*a* through 50*r*.

As shown in FIG. 9, the retaining flap 10*b* comprises on a first surface 24*b* and a second surface 26*b* a plurality of bonding strips, one of the bonding strips being shown and denominated by the reference numeral 20*b*. The bonding strips contact portions of the floral grouping assemblies 50*a* to 50*r*, thereby cooperating with the structure of the retaining flap 10*b* to hold the floral grouping assemblies 50*a* to 50*r* essentially immobile when the floral grouping, assemblies 50*a* to 50*r* are disposed within the carton 56.

Figure 10:
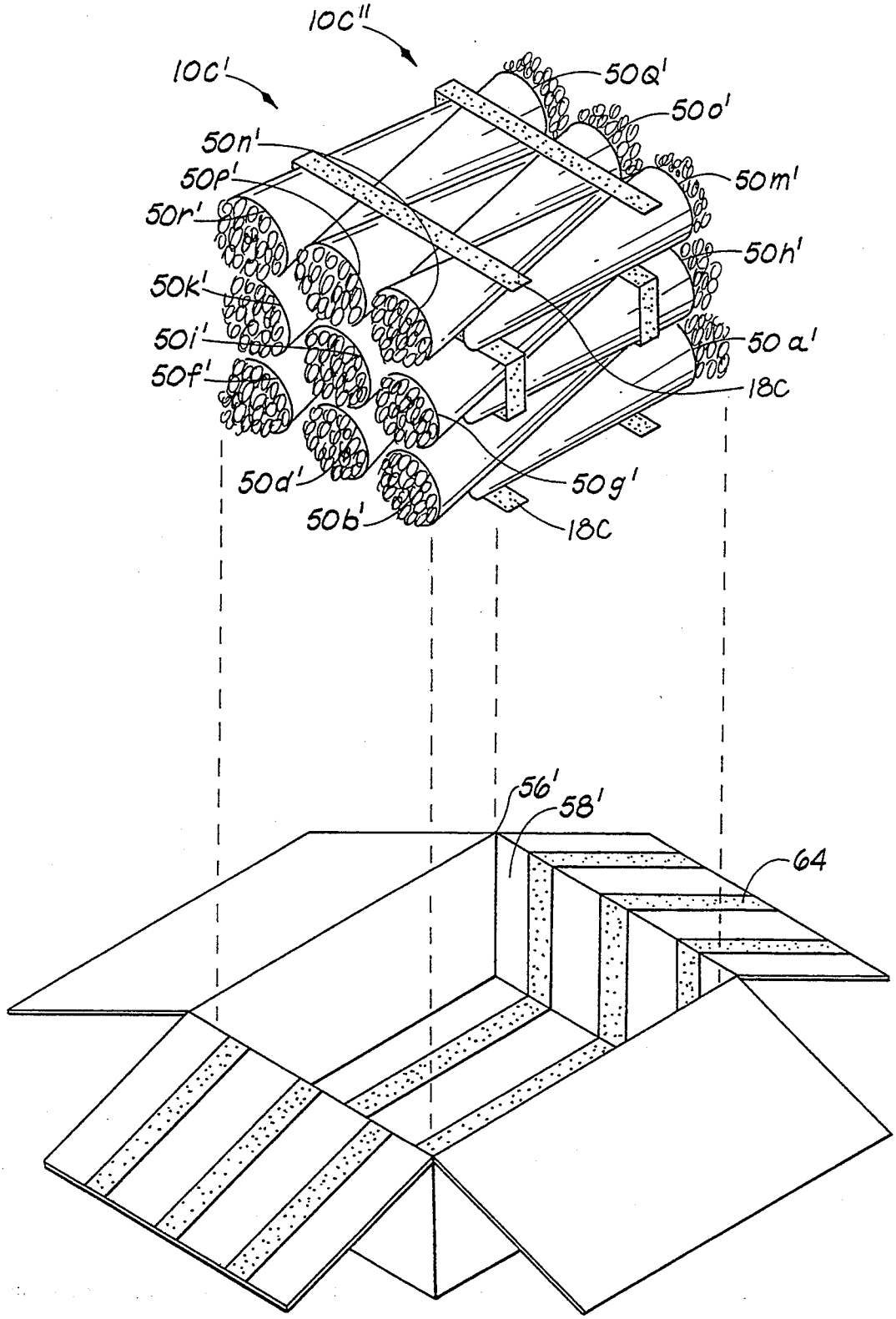
FIG. 10 is a perspective view of two retaining flaps, similar to the retaining flap shown in FIG. 4, disposed about a plurality of floral grouping assemblies.

Shown in FIG. 10 are two retaining flaps 10*c'* and 10*c''*. The retaining flaps 10*c'* and 10*c''* operate in exactly the same manner as the retaining flap 10*b* shown in FIG. 9, except that the retaining flap 10*b*, when disposed around the floral grouping assemblies 50*a* to 50*r* generally encompasses the floral grouping assemblies, whereas the retaining flaps 10*c'* and 10*c''* each encompass only a portion of the floral grouping assemblies 50*a'* to 50*r''*. Additionally, the bonding material 18 disposed on the retaining flaps 10*c'* and 10*c''* in this embodiment of the invention, comprise a cohesive. For that reason, the floral wrap comprising a portion of the floral grouping assemblies 50*a'* through 50*r''* must be at least partially covered with a cohesive, as shown in FIG. 10. Additionally, the carton 56', shown disposed below the first layer of floral grouping assemblies 50*a'* through 50*f'*, the second layer of floral grouping assemblies 50*g'* through 501' and the third layer of floral grouping assemblies 50*m'* through 50*r'* has cohesive disposed in the form of cohesive strips across at least a portion of the interior 56' of the carton 58'. One of the cohesive strips is designated by the numeral 64. In operation, the cohesive disposed on the retaining flaps 10*c'* and 10*c''* will releasably connect to a portion of the cohesive strips, such as the cohesive strip 64, disposed on the interior surface 58' of the carton 56', cooperating to hold the retaining strips 10*c'* and 10*c''* essentially mobile within the carton 56'. In turn, the cohesive on the retaining flaps 10*c'* and 10*c''* will releasably connect to the cohesive disposed on a portion of the floral grouping assemblies 50*a'* through 50*r'* to hold the floral grouping assemblies 50*a'* through 50*r'* essentially immobile within the retaining flaps 10*c'* and 10*c''* when the retaining flaps 10*c*, and 10*c''* are disposed within the carton 56'.

Figure 11:
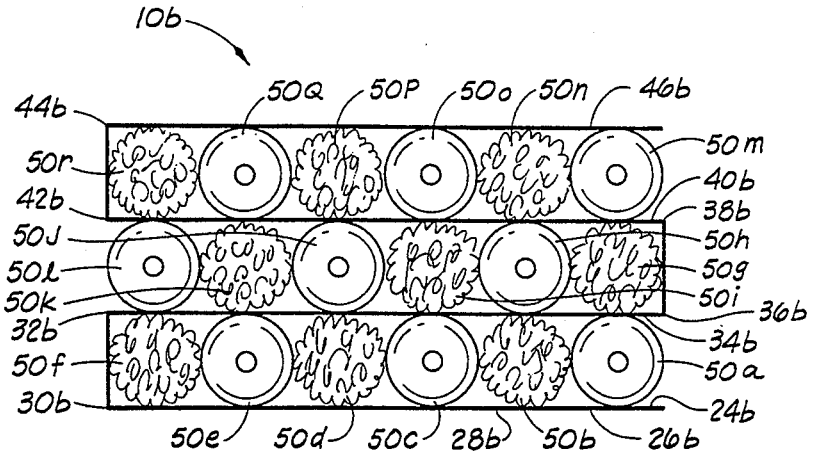
FIG. 11 is a side view of the retaining flap shown in FIG. 3, disposed about a plurality of floral grouping assemblies.

Shown in FIG. 11 is a side view of the retaining flap 10*b* shown in FIG. 3, disposed about a first layer of floral grouping assemblies. 50*a* through 50*f*, a second layer of floral grouping assemblies 50*g* through 501, and a third layer of floral grouping assemblies 50*m* through 50*r*. The first panel 28*b* and the upper surface 24*b* of the second panel 34*b* generally encompass the first layer of floral grouping assemblies 50*a* through 50*f*, the lower surface 26*b* of the second panel 34*b* in the lower surface 26*b* of the third panel 40*b* generally encompass the second level of floral grouping assemblies 50*g* through 501, and the upper surface 24*b* of the third panel 40*b* and the upper surface 24*b* of the fifth panel 46*b* generally encompass the third level of floral grouping assemblies 50*m* through 50*r*. As shown in FIG. 11, the first and second panels cooperate to form a first floral grouping retention pocket 29*b*, the second and third panels cooperate to form a second floral grouping retention pocket 37*b*, and the third and fourth panels cooperate to form a third floral grouping retention pocket 45*b*.

Figure 12:
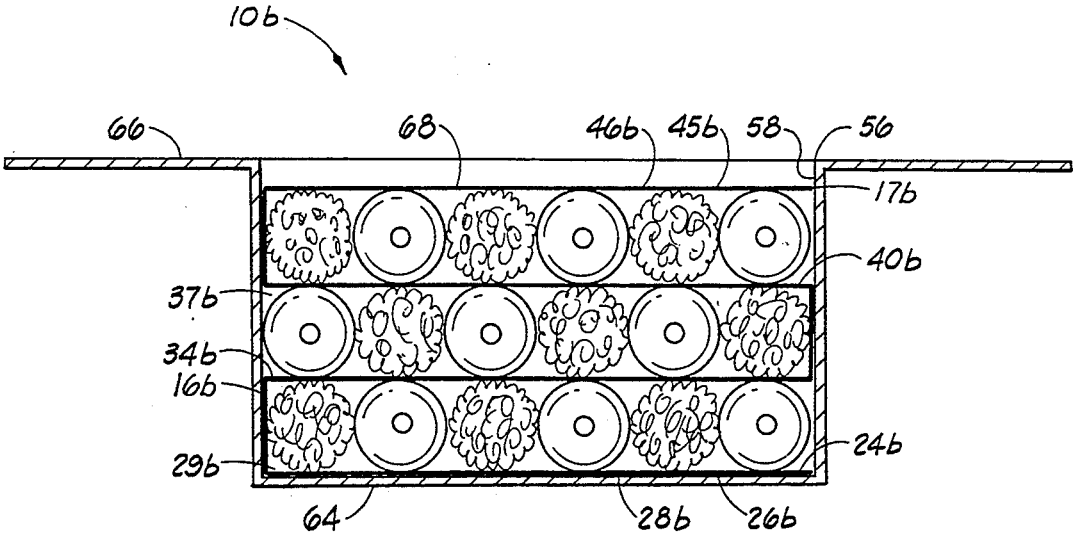
FIG. 12 is a side view of the retaining flap and floral grouping assembly shown in FIG. 11, disposed in a carton.

When placed in a carton 56 as shown in FIG. 12, the bonding strips disposed on a portion of the retaining flap 10*b* (not shown) releasably connect to a portion of the interior surface 58 of the carton 56, in order to hold the retaining flap 10*b* essentially immovable within the carton 56. Additionally, portions of other bonding strips disposed on the retaining flap 10*b* releasably connect with portions of the floral grouping assemblies 50*a* to 50*r*, thereby cooperating with the rigidity of the first panel 28*b*, the second panel 34*b*, the fourth panel 40*b* and the fifth panel 46*b* to hold the floral grouping assemblies 50*a* to 50*r* essentially immobile when the floral grouping assemblies 50, disposed within the retaining flap 10*b*, are inserted and encompassed by the carton 56.

Changes may be made in the embodiments of the invention described herein or in parts or elements of the embodiments described herein or in the steps or in the sequence of steps of the methods described herein without departing from the spirit and scope of the invention as defined in the following claims.

What is claimed is:

1. A shipping carton assembly for holding a floral grouping, comprising:

a carton having an inner surface defining a receiving space; and a retaining flap comprising a sheet of material having a bonding material disposed thereon, the sheet of material being positioned about a portion of the floral grouping with the bonding material being positioned on the sheet of material whereby the bonding material is releasably connected to the carton for connecting the sheet of material to the carton by way of the bonding material for cooperating to hold the floral grouping generally immobile within the receiving space of the carton.

2. The shipping carton assembly of claim 1 wherein the sheet of material is defined further as having a first side and a second side, with bonding material being disposed on the second side of the sheet of material, the sheet of material being disposed about a portion of the floral grouping and positioned so that the first side of the sheet of material is disposed adjacent the floral grouping, the second side of the sheet of material being positioned adjacent the inner surface of the carton and the bonding material on the second side of the sheet of material bondingly connecting the sheet of material to the carton.

3. The shipping carton assembly of claim 2 wherein the sheet of material is defined further as being wrapped about a portion of the floral grouping.

4. The shipping carton assembly of claim 1 wherein the bonding material comprises an adhesive.

5. The shipping carton assembly of claim 1 wherein the bonding material comprises a cohesive and wherein the inner surface of the carton is further defined as having a cohesive disposed on at least a portion thereof.

6. A shipping carton assembly for holding a plurality of floral groupings disposed in at least a first and a second layer of floral groupings, comprising:

a carton having an inner surface defining a receiving space; and a retaining flap comprising a sheet of material having a bonding material disposed on at least a portion thereof, the sheet of material extending about a portion of the first layer of floral groupings and about a portion of the second layer of floral groupings, the bonding material being positioned on the sheet of material whereby the bonding material on the sheet of material bondingly connects the sheet of material to the shipping carton.

7. The shipping carton assembly of claim 6 wherein the sheet of material is defined further as having a first side and a second side, and wherein the sheet of material is defined further as being disposed adjacent a portion of the floral groupings in the first layer of floral groupings with the first side of the sheet of material being disposed adjacent the floral groupings in the first layer of floral groupings and the sheet of material extending along the first layer of floral groupings and is wrapped over and extends back between the first layer of floral groupings and the second layer of floral groupings with the second side of the sheet of material being disposed adjacent the floral groupings in the second layer of floral groupings, a portion of the bonding material on the second side of the sheet of material engaging and bondingly connecting the sheet of material to the carton.

8. The shipping carton assembly of claim 7 wherein the sheet of material is defined further as extending over and back along the second row of floral groupings.

9. The shipping carton assembly of claim 6 wherein the bonding material is defined further as an adhesive.

10. The shipping carton assembly of claim 6 wherein the bonding material comprises a cohesive and wherein the inner surface of the carton is further defined as having a cohesive disposed on at least a portion thereof.

11. A shipping carton assembly for holding a plurality of floral groupings, comprising:

a carton having an inner surface defining a receiving space; and a retaining flap comprising a sheet of material having a first side and a second side with bonding material being disposed on the second side, at least two fold lines being formed in the sheet of material and positioned whereby the sheet of material is folded along the fold lines to form a retention pocket, at least one of the floral groupings being disposed in the pocket with the first side of the sheet of material extending along one side of the floral grouping and being folded at the fold lines and extending along an opposite side of the floral grouping disposed in the pocket, the remaining floral groupings being disposed on the second side of the sheet of material above the retention pocket, a portion of the bonding material disposed on the second side of the sheet of material bondingly connecting the sheet of material to the carton.

12. The shipping carton assembly of claim 11 wherein the bonding material further comprises an adhesive.

13. The shipping carton assembly of claim 11 wherein the sheet of material is defined further as having four fold lines formed in the sheet of material and positioned whereby the sheet of material is folded along the fold lines to form a first retention pocket and a second retention pocket, at least one of the floral groupings being disposed in the first retention pocket with the first side of the sheet of material extending along one side of the floral grouping, the sheet of material being folded at two of the fold lines and extending along an opposite side of the floral grouping disposed in the first retention pocket, the remaining floral groupings being disposed on the second side of the sheet of material above the retention pocket, the sheet of material being folded at two additional fold lines, forming thereby the second retention pocket, with the second side of the sheet of material extending along a side of the floral groupings, portions of the bonding material disposed on the second side of the sheet of material bondingly connecting the sheet of material to the carton.

14. The shipping carton assembly of claim 11 wherein the bonding material comprises a cohesive and wherein the inner surface of the carton is further defined as having a cohesive disposed on at least a portion thereof.

15. A shipping carton assembly for holding a floral grouping assembly having a floral grouping and a floral grouping wrap, the assembly comprising:

a carton having an inner surface defining a receiving space; and a retaining flap comprising a sheet of material having a bonding material disposed thereon, the sheet of material being positioned about a portion of the floral grouping assembly with the bonding material being positioned on the sheet of material whereby the bonding material is releasably connected to the carton for connecting the sheet of material to the carton by way of the bonding material for cooperating to hold the floral grouping assembly generally immobile within the receiving space of the carton.

16. The shipping carton assembly of claim 15 wherein the sheet of material is defined further as having a first side and a second side, with bonding material being disposed on the second side of the sheet of material, the sheet of material being disposed about a portion of the floral grouping assembly and positioned so that the first side of the sheet of material is disposed adjacent the floral grouping assembly, the second side of the sheet of material being positioned adjacent the inner surface of the carton and the bonding material on the second side of the sheet of material bondingly connecting the sheet of material to the carton.

17. The shipping carton assembly of claim 16 wherein the sheet of material is defined further as being wrapped about a portion of the floral grouping assembly.

18. The shipping carton assembly of claim 15 wherein the bonding material comprises an adhesive.

19. The shipping carton assembly of claim 15 wherein the bonding material comprises a cohesive and wherein the inner surface of the carton is further defined as having a cohesive disposed on at least a portion thereof.

20. A shipping carton assembly for holding a plurality of floral grouping assemblies disposed in at least a first and a second layer of floral grouping assemblies, the carton assembly comprising:

a carton having an inner surface defining a receiving space; and a retaining flap comprising a sheet of material having a bonding material disposed on at least a portion thereof, the sheet of material extending about a portion of the first layer of floral grouping assemblies and about a portion of the second layer of floral grouping assemblies, the bonding material being positioned on the sheet of material whereby the bonding material on the sheet of material bondingly connects the sheet of material to the shipping carton.

21. The shipping carton assembly of claim 20 wherein the sheet of material is defined further as having a first side and a second side, and wherein the sheet of material is defined further as being disposed adjacent a portion of the floral grouping assemblies in the first layer of floral grouping assemblies with the first side of the sheet of material being disposed adjacent the floral grouping assemblies in the first layer of floral grouping assemblies and the sheet of material extending along the first layer of floral grouping assemblies and is wrapped over and extends back between the first layer of floral grouping assemblies and the second layer of floral grouping assemblies with the second side of the sheet of material being disposed adjacent the floral grouping assemblies in the second layer of floral grouping assemblies, a portion of the bonding material on the second side of the sheet of material engaging and bondingly connecting the sheet of material to the carton.

22. The shipping carton assembly of claim 21 wherein the sheet of material is defined further as extending over and back along the second row of floral grouping assemblies.

23. The shipping carton assembly of claim 20 wherein the bonding material is defined further as an adhesive.

24. The shipping carton assembly of claim 20 wherein the bonding material comprises a cohesive and wherein the inner surface of the carton is further defined as having a cohesive disposed on at least a portion thereof.

25. A shipping carton assembly for holding a plurality of floral grouping assemblies, comprising:

a carton having an inner surface defining a receiving space; and a retaining flap comprising a sheet of material having a first side and a second side with bonding material being disposed on the second side, at least two fold lines being formed in the sheet of material and positioned whereby the sheet of material is folded along the fold lines to form a retention pocket, at least one of the floral grouping assemblies being disposed in the pocket with the first side of the sheet of material extending along one side of the floral grouping assembly and being folded at the fold lines and extending along an opposite side of the floral grouping assembly disposed in the pocket, the remaining floral grouping assemblies being disposed on the second side of the sheet of material above the retention pocket, a portion of the bonding material disposed on the second side of the sheet of material bondingly connecting the sheet of material to the carton.

26. The shipping carton assembly of claim 25 wherein the bonding material further comprises an adhesive.

27. The shipping carton assembly of claim 25 wherein the bonding material comprises a cohesive and wherein the inner surface of the carton is further defined as having a cohesive disposed on at least a portion thereof.

28. The shipping carton assembly of claim 25 wherein the sheet of material is defined further as having four fold lines formed in the sheet of material and positioned whereby the sheet of material is folded along the fold lines to form a first retention pocket and a second retention pocket, at least one of the floral grouping assemblies being disposed in the first retention pocket with the first side of the sheet of material extending along one side of the floral grouping assembly, the sheet of material being folded at two of the fold lines and extending along an opposite side of the floral grouping assembly disposed in the first retention pocket, the remaining floral grouping assemblies being disposed on the second side of the sheet of material above the first retention pocket, the sheet of material being folded at two additional fold lines, forming thereby the second retention pocket, with the second side of the sheet of material extending along a side of the floral grouping assemblies, and portions of the bonding material disposed on the second side of the sheet of material bondingly connecting the sheet of material to the carton.

* * * * *

UNITED STATES PATENT AND TRADEMARK OFFICE

CERTIFICATE OF CORRECTION

PATENT NO. : 5,411,137

DATED : May 2, 1995

INVENTOR(S) : Weder et al.

It is certified that error appears in the above-identified patent and that said Letters Patent is hereby corrected as shown below:

Column 2, line 16, please delete "is" and substitute therefor -- as --.

Column 2, line 19, after "film" please delete ",".

Column 2, line 47, please delete "end" and substitute therefor -- and --.

Column 3, line 7, please delete "separate" and substitute therefor -- separated --.

Column 3, line 21, after "numeral" please insert -- 20. --.

Column 3, line 25, please delete ". A" and substitute therefor -- , a --.

Column 3, line 28, please delete "e second" and substitute therefor -- a second --.

Column 3, line 29, after "40c" please insert -- and --.

Column 3, line 39, please delete "bonding material 18" and substitute therefor -- bonding material 18c --.

Column 3, line 41, please delete "first side 24c" and substitute therefor -- upper surface 24c --.

UNITED STATES PATENT AND TRADEMARK OFFICE

CERTIFICATE OF CORRECTION

PATENT NO. : 5,411,137

DATED : May 2, 1995

INVENTOR(S) : Weder et al.

It is certified that error appears in the above-identified patent and that said Letters Patent is hereby corrected as shown below:

Column 3, line 42, please delete "second side 26c" and substitute therefor -- lower surface 26c --.

Column 4, line 3, please delete "groupings" and substitute therefor -- grouping --.

Column 4, lines 15-16, please delete "first surface 14" and substitute therefor -- upper surface 14 --.

Column 4, lines 60-61, please delete "50g and 50l" and substitute therefor -- 50g to 50l --.

Column 4, line 62, please delete "50m and 50r" and substitute therefor -- 50m to 50r --.

Column 5, lines 1-2, please delete "or since flap 10'".

Column 5, line 8, please delete "and" and substitute therefor -- are --.

Column 5, line 10, after "FIG. 7" please delete ",".

Column 5, line 23, please delete "sheet of material 22" and substitute therefor -- sheet of material 12 --.

UNITED STATES PATENT AND TRADEMARK OFFICE

CERTIFICATE OF CORRECTION

PATENT NO. : 5,411,137

DATED : May 2, 1995

INVENTOR(S) : Weder et al.

It is certified that error appears in the above-identified patent and that said Letters Patent is hereby corrected as shown below:

Column 5, line 25, please delete "sheet of material 22" and substitute therefor -- sheet of material 12 --.

Column 5, line 28, please delete "sheet of material 22" and substitute therefor -- sheet of material 12 --.

Column 5, line 29, please delete "sheet of material 22" and substitute therefor -- sheet of material 12 --.

Column 5, line 32, please delete "sheet of material 22" and substitute therefor -- sheet of material 12 --.

Column 5, line 41, please delete "an".

Column 5, line 52, please delete "second panel 32b" and substitute therefor -- second panel 34b --.

Column 5, line 54, please delete "floral grouping assemblies 50h" and substitute therefor -- floral grouping assemblies 50g --.

Column 6, line 11, after "grouping" please delete ",".

UNITED STATES PATENT AND TRADEMARK OFFICE

CERTIFICATE OF CORRECTION

PATENT NO. : 5,411,137

DATED : May 2, 1995

INVENTOR(S) : Weder et al.

It is certified that error appears in the above-identified patent and that said Letters Patent is hereby corrected as shown below:

Column 6, line 21, please delete "50r"" and substitute therefor -- 50r' --.

Column 6, line 21, please delete "bonding material 18" and substitute therefor -- bonding material 18c --.

Column 6, line 25, please delete "50r"" and substitute therefor -- 50r' --.

Column 6, line 33, please delete "interior 56'" and substitute therefor -- interior 58' --.

Column 6, line 33, please delete "carton 58'" and substitute therefor -- carton 56' --.

Column 6, line 39, please delete "retaining strips" and substitute therefor -- retaining flaps --.

Column 6, line 47, please delete "10c," and substitute therefor -- 10c' --.

Column 6, line 51, please delete "." after "assemblies".

Column 6, line 57, please delete "in" and substitute therefor -- and --.

UNITED STATES PATENT AND TRADEMARK OFFICE

CERTIFICATE OF CORRECTION

PATENT NO. : 5,411,137

DATED : May 2, 1995

INVENTOR(S) : Weder et al.

It is certified that error appears in the above-identified patent and that said Letters Patent is hereby corrected as shown below:

Column 6, line 61, please delete "fifth panel 46b" and substitute therefor -- fourth panel 46b --.

Column 7, line 10, please delete "fourth panel 40b" and substitute therefor -- third panel 40b --.

Column 7, line 11, please delete "fifth panel 46b" and substitute therefor -- fourth panel 46b --.

Signed and Sealed this

Twenty-sixth Day of September, 1995

Bruce Lehman

*Attest:*

BRUCE LEHMAN

*Attesting Officer*

*Commissioner of Patents and Trademarks*